US009664345B2

(12) United States Patent
Copeland

(10) Patent No.: US 9,664,345 B2
(45) Date of Patent: May 30, 2017

(54) TASK LAMP

(71) Applicant: Light Corporation, Grand Haven, MI (US)

(72) Inventor: Stephan Copeland, Merion Station, PA (US)

(73) Assignee: Light Corporation, Grand Haven, MI (US)

( * ) Notice: Subject to any disclaimer, the term of this patent is extended or adjusted under 35 U.S.C. 154(b) by 20 days.

(21) Appl. No.: 14/837,602

(22) Filed: Aug. 27, 2015

(65) Prior Publication Data

US 2016/0153628 A1 Jun. 2, 2016

Related U.S. Application Data

(60) Provisional application No. 62/070,474, filed on Aug. 27, 2014, provisional application No. 62/124,619, filed on Dec. 29, 2014.

(51) Int. Cl.

| | |
|---|---|
| ***F21V 17/02*** | (2006.01) |
| ***F21S 6/00*** | (2006.01) |
| ***F21V 21/06*** | (2006.01) |
| *F21V 21/30* | (2006.01) |
| *F21Y 115/10* | (2016.01) |

(52) U.S. Cl.

CPC ..... *F21S 6/003* (2013.01); *F21V 21/06* (2013.01); *F21V 21/30* (2013.01); *F21Y 2115/10* (2016.08)

(58) Field of Classification Search

CPC F21S 6/003; F21S 6/006; F21V 21/06; F21V 21/30

USPC ..... 362/282, 389, 401, 410, 414; 248/123.1

See application file for complete search history.

(56) References Cited

U.S. PATENT DOCUMENTS

| | | | | |
|---|---|---|---|---|
| 3,077,537 A * | 2/1963 | Squier | F21S 6/005 | 248/181.1 |
| 3,789,213 A * | 1/1974 | Sonneman | F21V 21/26 | 240/69 |
| 5,001,617 A * | 3/1991 | Chan | F21V 21/06 | 362/269 |
| D349,582 S * | 8/1994 | Bain | D26/107 | |
| 2008/0232104 A1 * | 9/2008 | Freeman | A47F 11/10 | 362/249.07 |

* cited by examiner

*Primary Examiner* — Anh Mai
*Assistant Examiner* — Michael Chiang
(74) *Attorney, Agent, or Firm* — Gardner, Linn, Burkhart & Flory, LLP

(57) ABSTRACT

A task lamp with a housing having a lower end adapted to rest on a support surface, a distal end located above the surface, and a light source at or near the distal end of the housing. The lower end of the housing has at least two angled surfaces that are adapted to rest on the support surface, one at a time, so as to support the light source at a particular location relative to the angled surface, where the location is different for each angled surface.

15 Claims, 12 Drawing Sheets

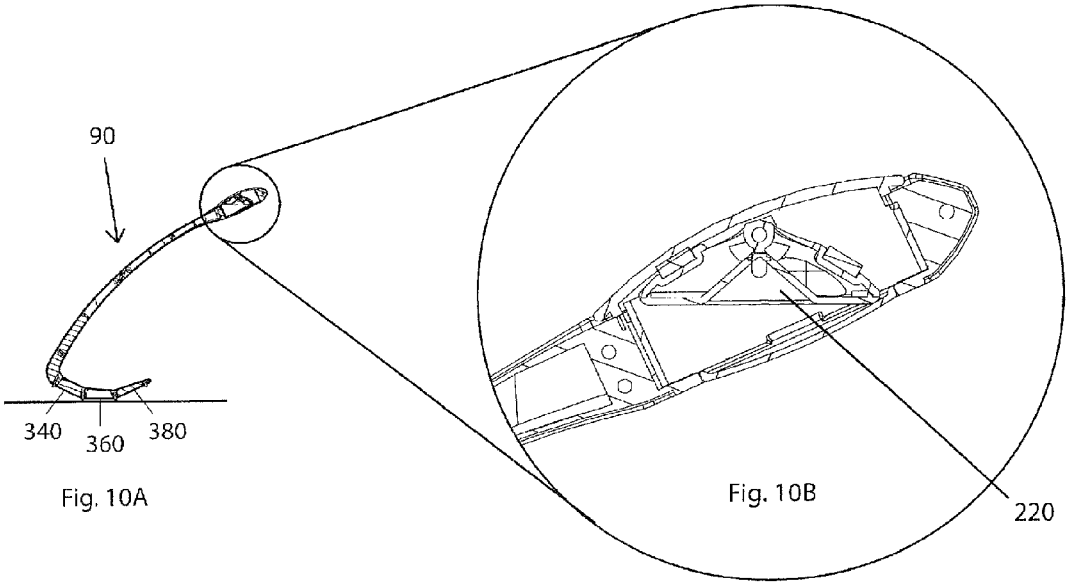
Fig. 10A
Fig. 10B
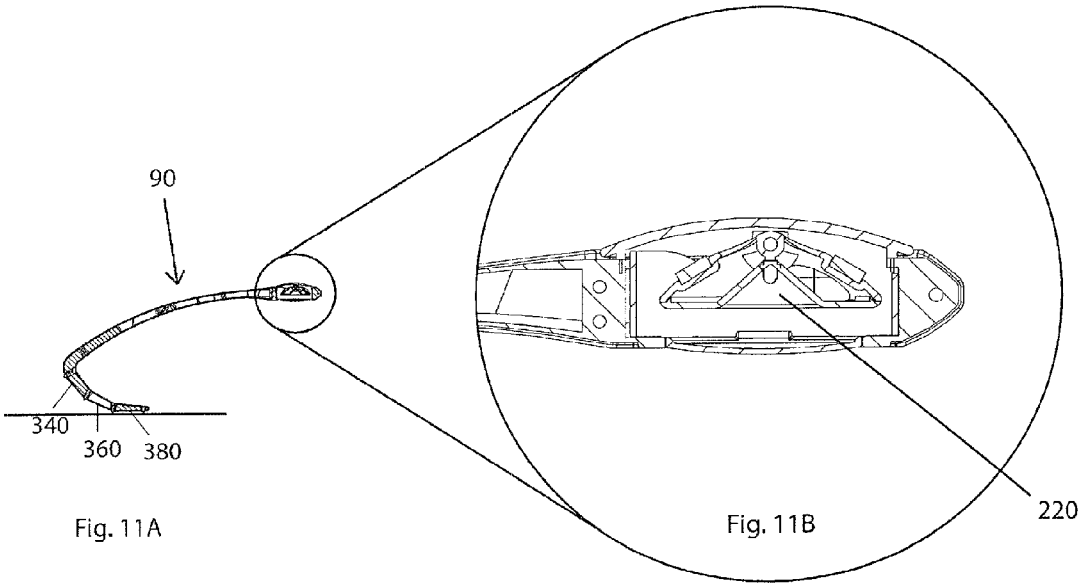
Fig. 11A
Fig. 11B

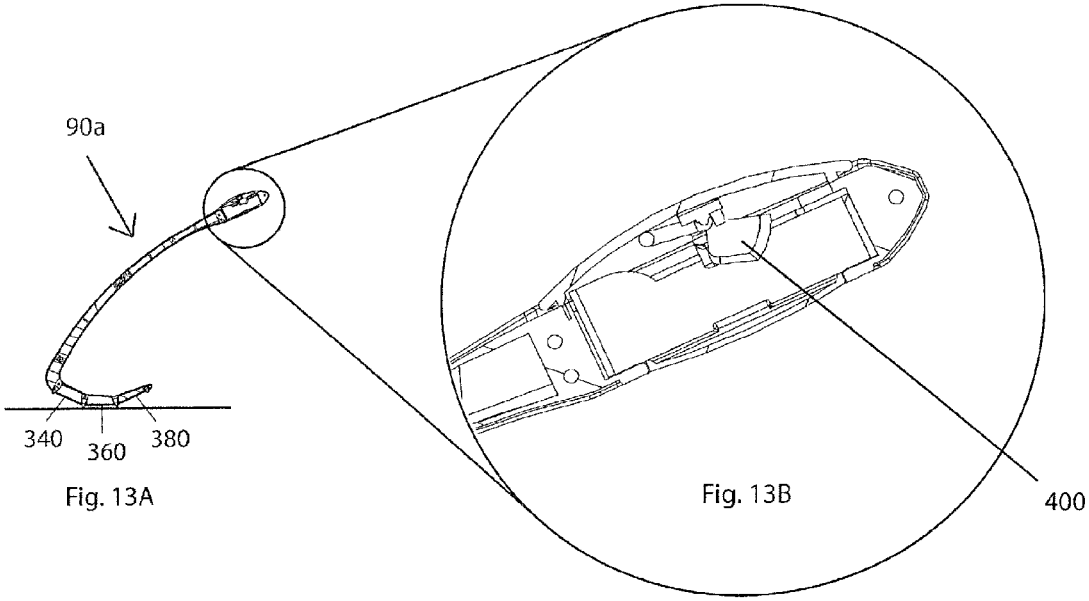
Fig. 13A
Fig. 13B
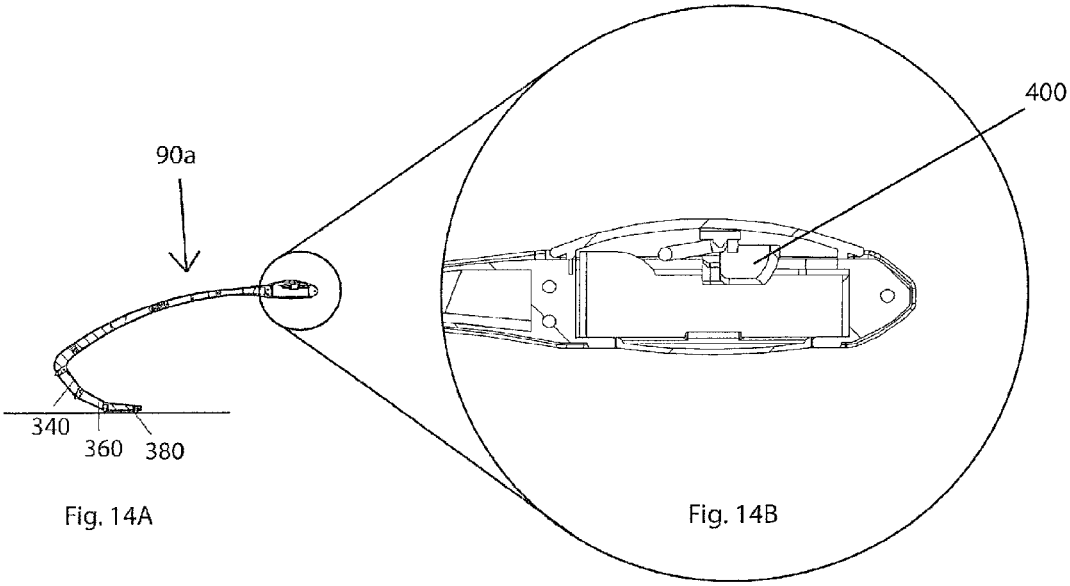
Fig. 14A
Fig. 14B

TASK LAMP

CROSS-REFERENCE TO RELATED APPLICATIONS

This application claims priority of Provisional Patent Application No. 62/070,474, filed on Aug. 27, 2014 and Provisional Patent Application No. 62/124,619, filed on Dec. 29, 2014.

BACKGROUND

Field

This disclosure relates to desktop task lamps that give the user the ability to control the location and direction of light in a specific area to allow better visibility when illuminating a task.

Description of Related Art

There are many known devices that allow the user to adjust the location and direction of light being produced by the task lamp. This can be accomplished by the use of multiple pivots allowing the arms of the lamp to be manipulated into different positions. These pivots are usually accompanied by friction, spring assist, or a counter weight to keep the arms in the position.

SUMMARY

The task lamp allows the user to change the height and location of the light source using a base that has an angular geometry. This is accomplished with no pivots or moving parts. The base acts as a glide allowing the user to easily move the task lamp around the work surface. The head of the lamp is constructed and arranged to allow for fine-tuning the position and angle of the light. This can be accomplished in several manners, such as with a ball and socket arrangement, or a reflector or LED shade in the head of the lamp that can act as a gimbal which keeps from exposing the LED to other occupants in the room. The combination of these movements allows the user to get the light in the most effective position to illuminate the task.

This disclosure features a task lamp with a housing having a lower end adapted to rest on a support surface, a distal end located above the surface, and a light source at or near the distal end of the housing. The lower end of the housing has at least two angled surfaces that are adapted to rest on the support surface, one at a time, so as to support the light source at a particular location relative to the angled surface, where the location is different for each angled surface.

The lower end can include a weighted base. The weight may be sufficient to balance the lamp such that it can sit on an angled surface. The task lamp may further comprise a ball-shaped head that holds the light source and is received in a socket such that the ball can be adjusted in two orientations. The task lamp may further comprise a head that comprises a reflector located above the light source, wherein the reflector is gimbaled such that it tends to remain in the same orientation as the head is moved. The task lamp may further comprise a head that comprises a shade located around the light source, wherein the shade is gimbaled such that it tends to remain in the same orientation as the head is moved.

BRIEF DESCRIPTION OF THE DRAWINGS

FIGS. 10A, 10B, 11A and 11B depict the reflector of the lamp of FIG. 6 moving via a gimbal action.

FIGS. 13A, 13B, 14A and 14B depicts the shade of the lamp of FIG. 12 moving via a gimbal action.

REFERENCE NUMERALS IN THE DRAWINGS

8—Task Lamp
10—Body housing left
12—On/Off switch/dimmer
14—Lamp Housing Top
16—Lamp Housing Bottom
17—Lamp Housing Assembly
18—Body housing right
19—Light Emitting Opening
20—Back angled surface
22—Mid angled surface
24—Front angled surface
26—Weight
28—Light Source
30—Pocket That Captures the Lamp Housing Assembly
31—Left Half of Pocket That Captures the Lamp Housing Assembly
32—Right Half of Pocket That Captures the Lamp Housing Assembly
90—Task Lamp
100—Body Housing left
118—Head Assembly
120—Dome
140—Body Housing right
160—USB port
180—Glides
220—Reflector
240—LED
260—Lens
280—Weights
300—Memory foam
320—Reflector axle
340—Back angled surface
360—Mid angled surface
380—Front angled surface
400—LED shade

DETAILED DESCRIPTION

Figure 1:
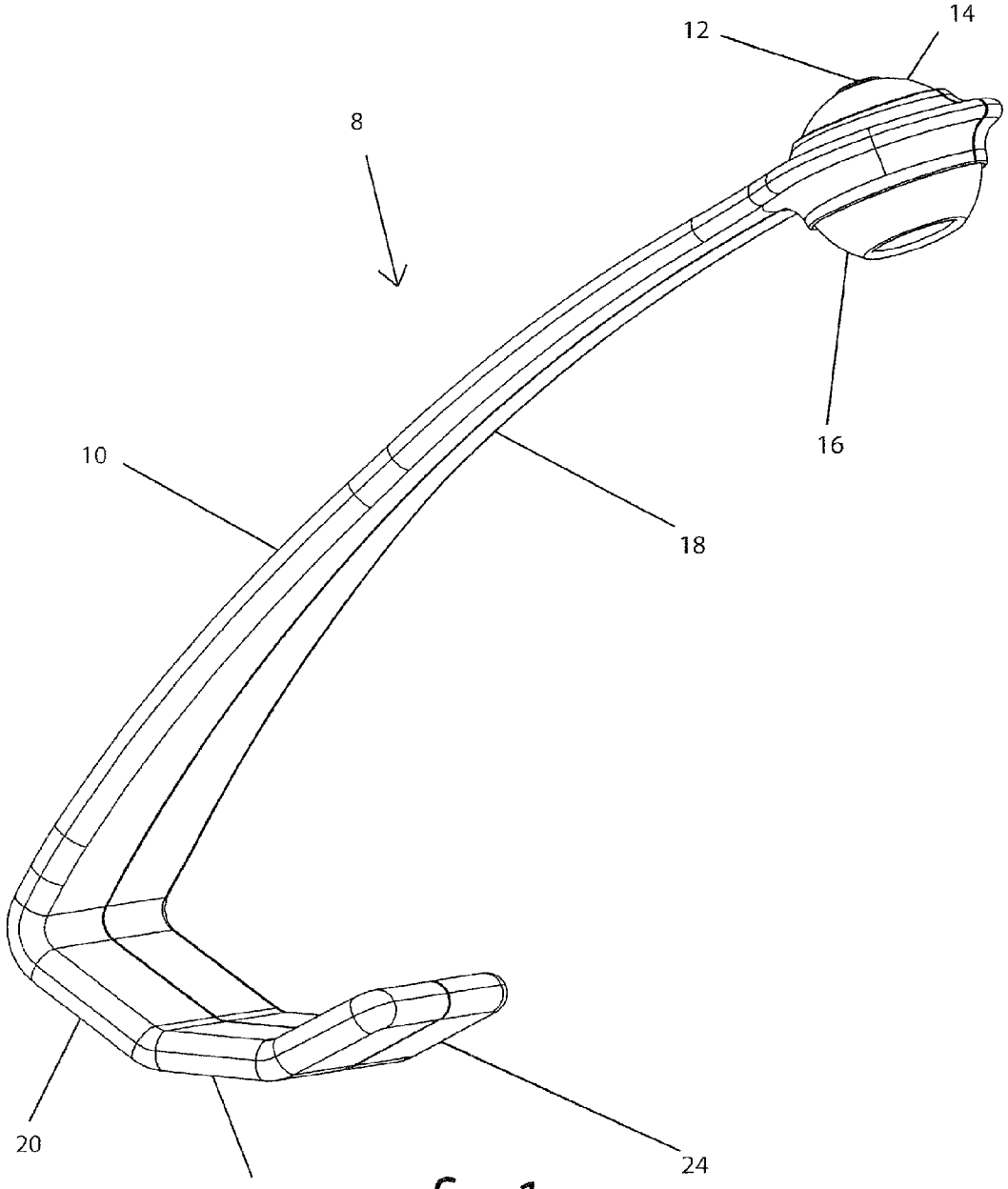
FIG. 1 is a perspective view of one example of a task lamp.
Figure 2:
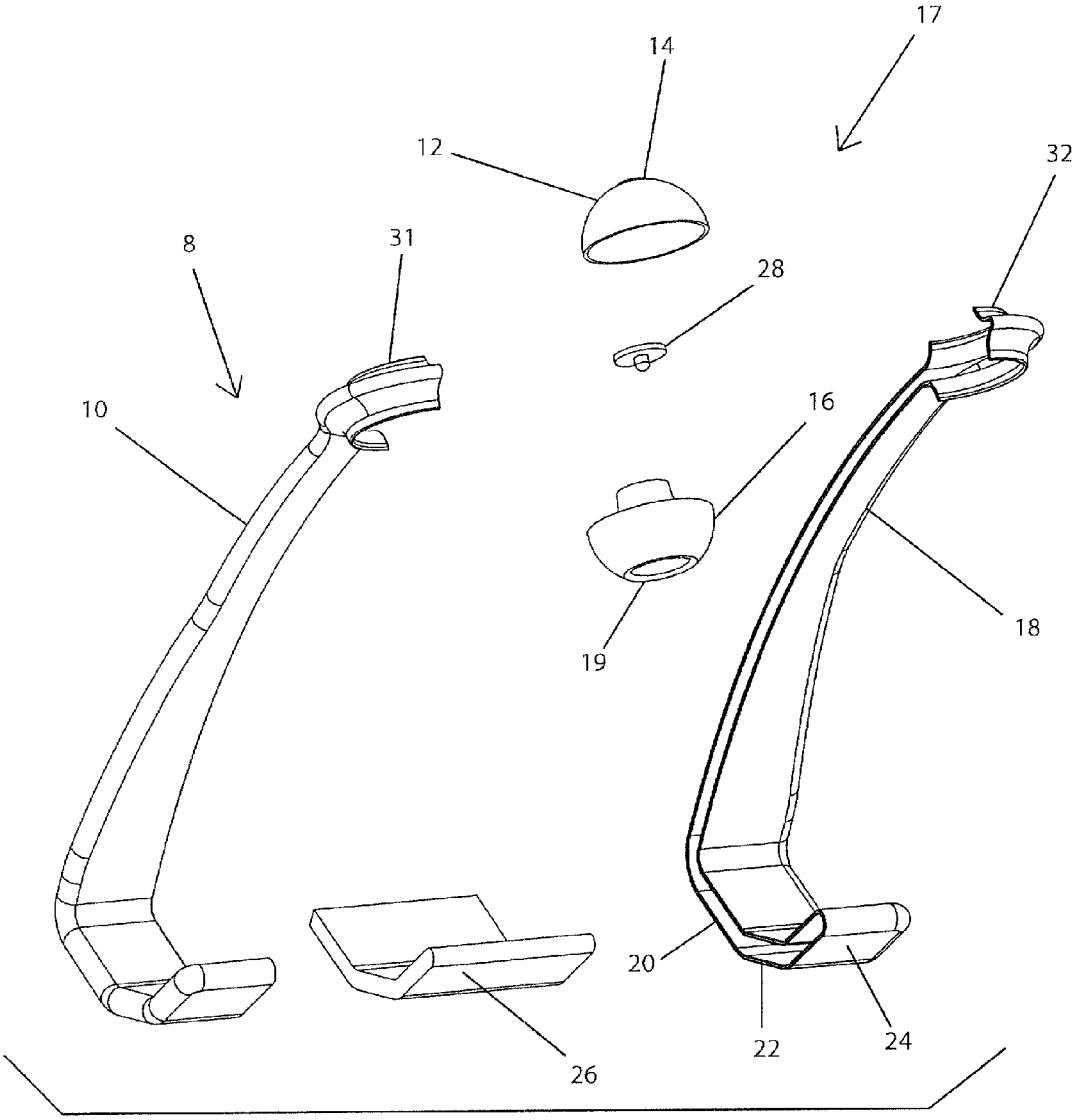
FIG. 2 is an exploded view thereof.

FIG. 1 depicts a perspective view of one example of a task lamp (8) according to the present disclosure. As seen in the exploded view in FIG. 2 lamp (8) is comprised of multiple parts: the body housing left (10), the body housing right (18), the lamp housing top (14), the lamp housing bottom (16) the on/off switch (12), the light source (28), and the weight (26). To assemble the lamp housing, the light source (28) (which may be but need not be an LED) gets captured between the lamp housing top (12) and the lamp housing bottom (16) creating a closed spherical shape. This lamp housing assembly (17) (consisting of parts 12, 14, 28, 16) and the weight (26) get captured in between the body housing left (10) and the body housing right (18) as depicted in FIG. 3.

Figure 3:
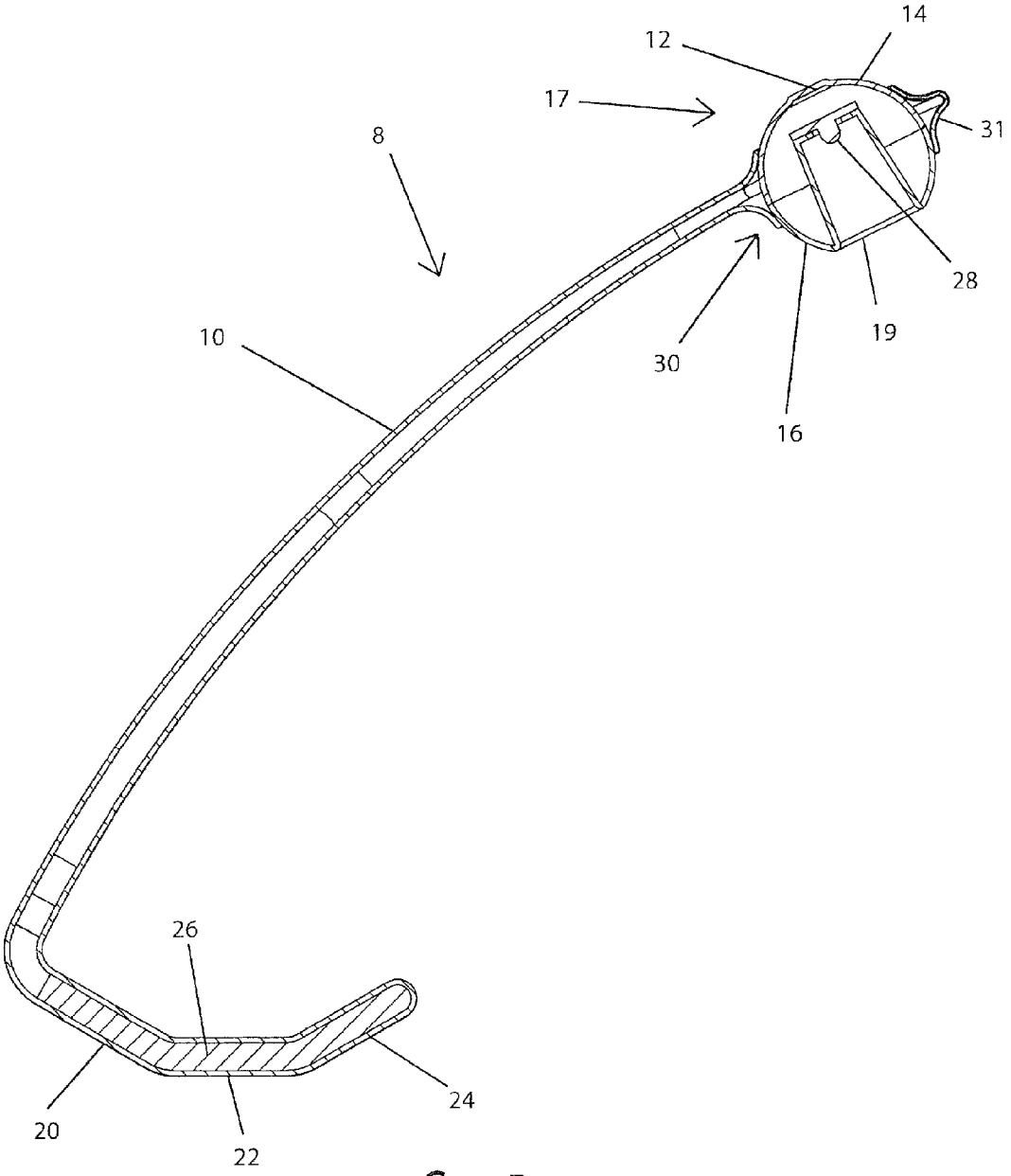
FIG. 3 is a section view taken through the center plane.
Figure 5:
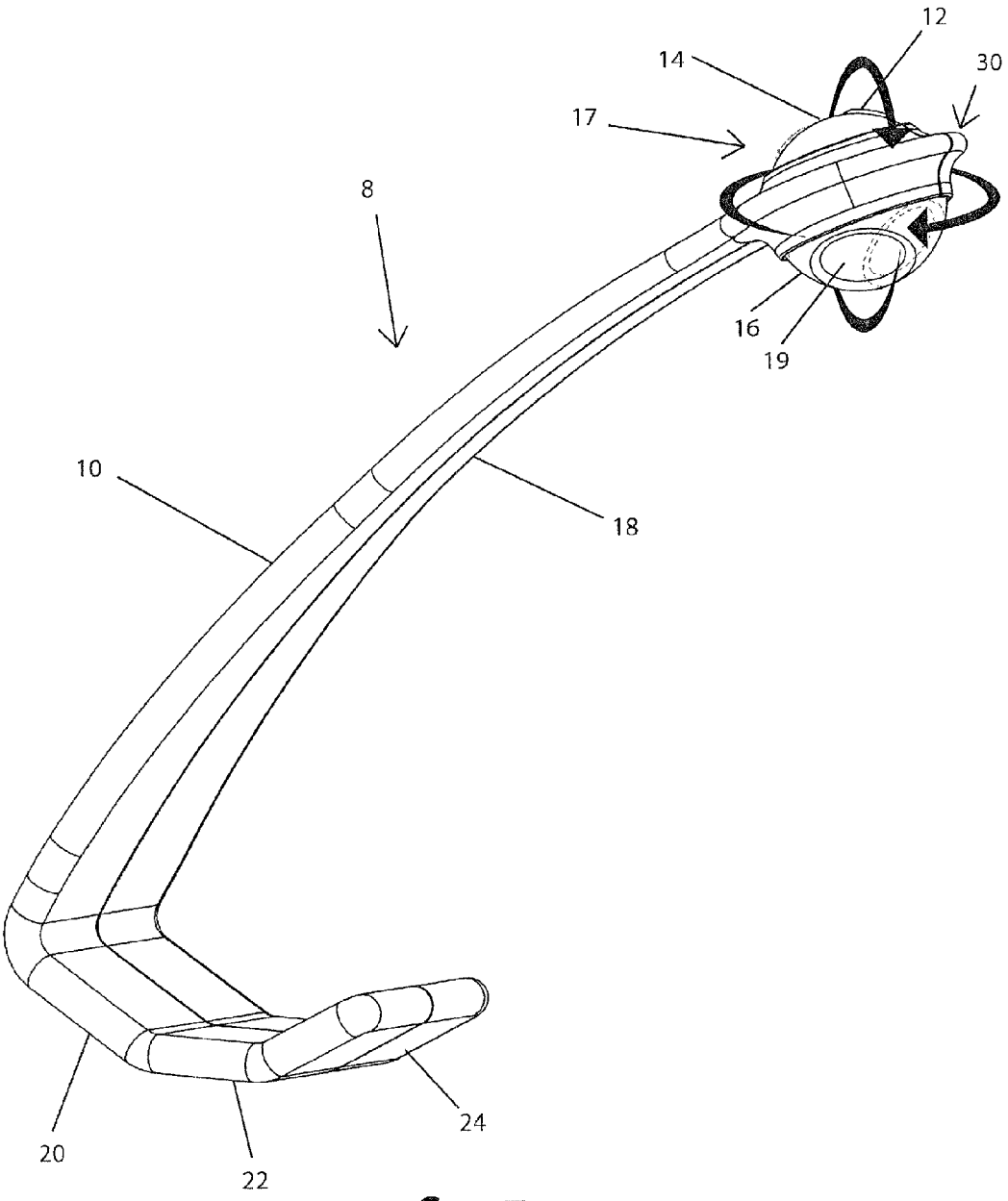
FIG. 5 depicts the head of the lamp moving.

FIG. 3 shows the spherical lamp housing assembly (17) held in a pocket (30) of the same shape, created by pocket halves (31) and (32). This allows the lamp housing assembly (17) to rotate in two axes within the pocket (30) as seen is FIG. 5. The rotation allows the user to change the angle and direction of the light emitted from opening (19). The light source (28) is set deep in the lamp housing to prevent the bulb from being exposed to the user or other people while in use.

Figure 4:
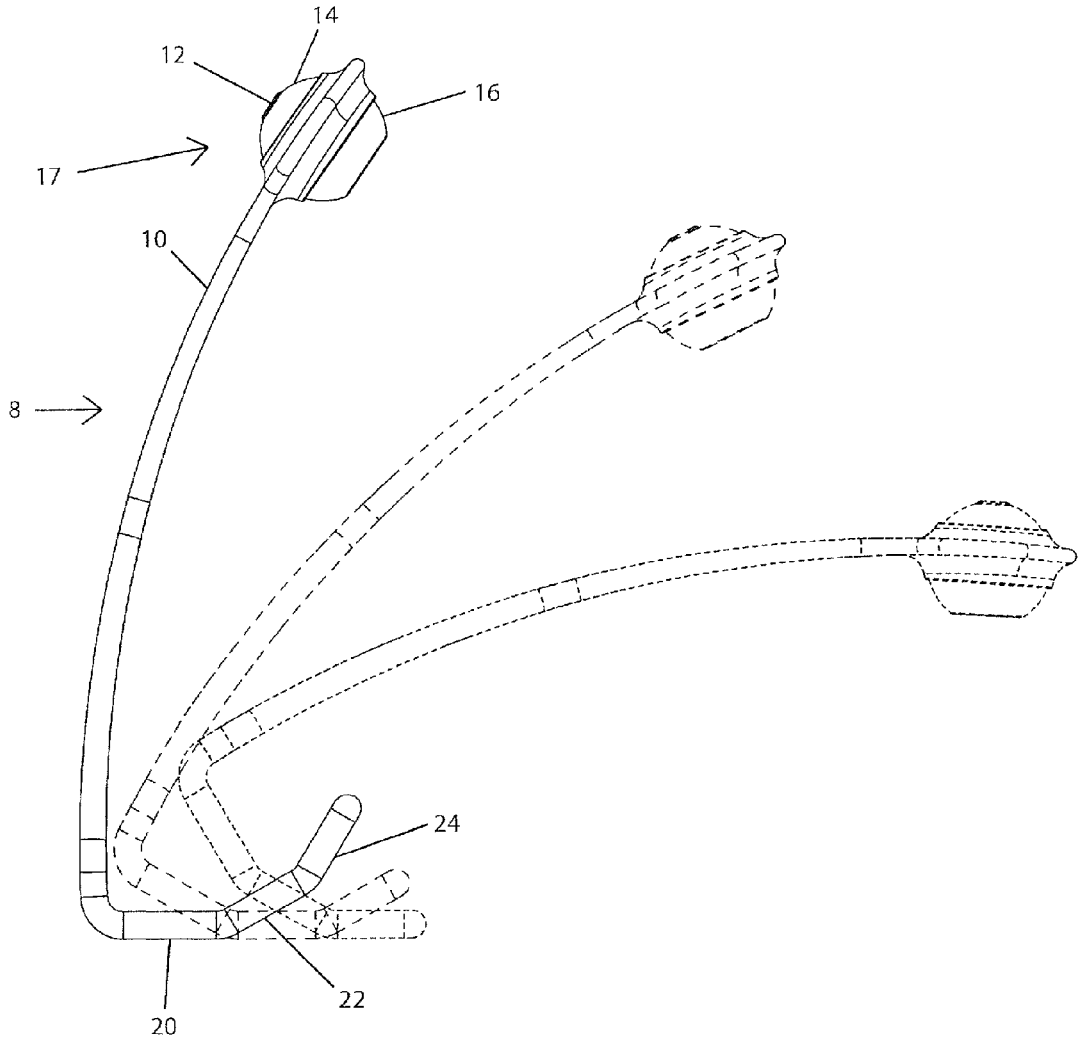
FIG. 4 illustrates the lamp in the three angle positions.

The weight (26) allows the lamp to balance on the three angled surfaces (20, 22, 24) created by the three flat sides on the bottom of the base. See FIG. 3. FIG. 4 shows how the three flat sides/surfaces (20, 22, 24) on the base manipulate the height and reach of the lamp (i.e., the location of the lamp head that includes the light source) above the lamp support surface (e.g., a desk or table on which the lamp is placed). The geometry depicted shows three facets (20, 22, 24) allowing for three different height and reach options. The lamp could include more or fewer facets to allow for more or fewer options of height and reach.

To use the lamp the user would activate the on/off switch (14), this would turn the light source (28) on. The user can select which angled surface (20, 22, 24) would give them the correct height and reach for the task at hand. The base can be (but need not be) made with smooth contact surfaces that sit on the work/support surface so the lamp can be slid around with ease. Once the user has the lamp in the right placement on the work surface and the height and reach set to their desired position, the head assembly (17) can be rotated around to adjust the angle of the light to get the most effective delivery of illumination on the task. To turn off the lamp the user would deactivate the on/off switch (14).

Figure 6:
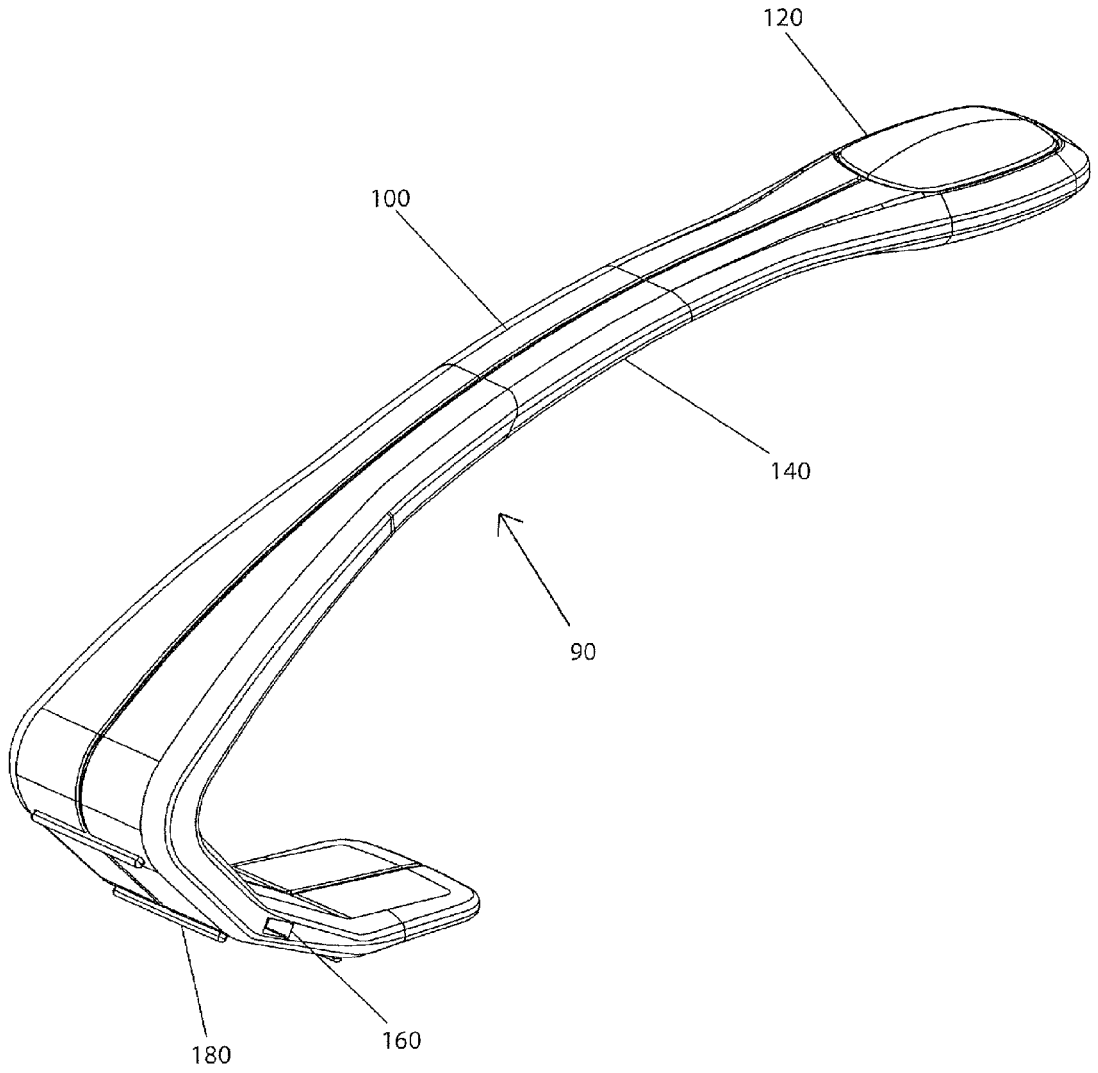
FIG. 6 is a perspective view of another example of the task lamp.
Figure 7:
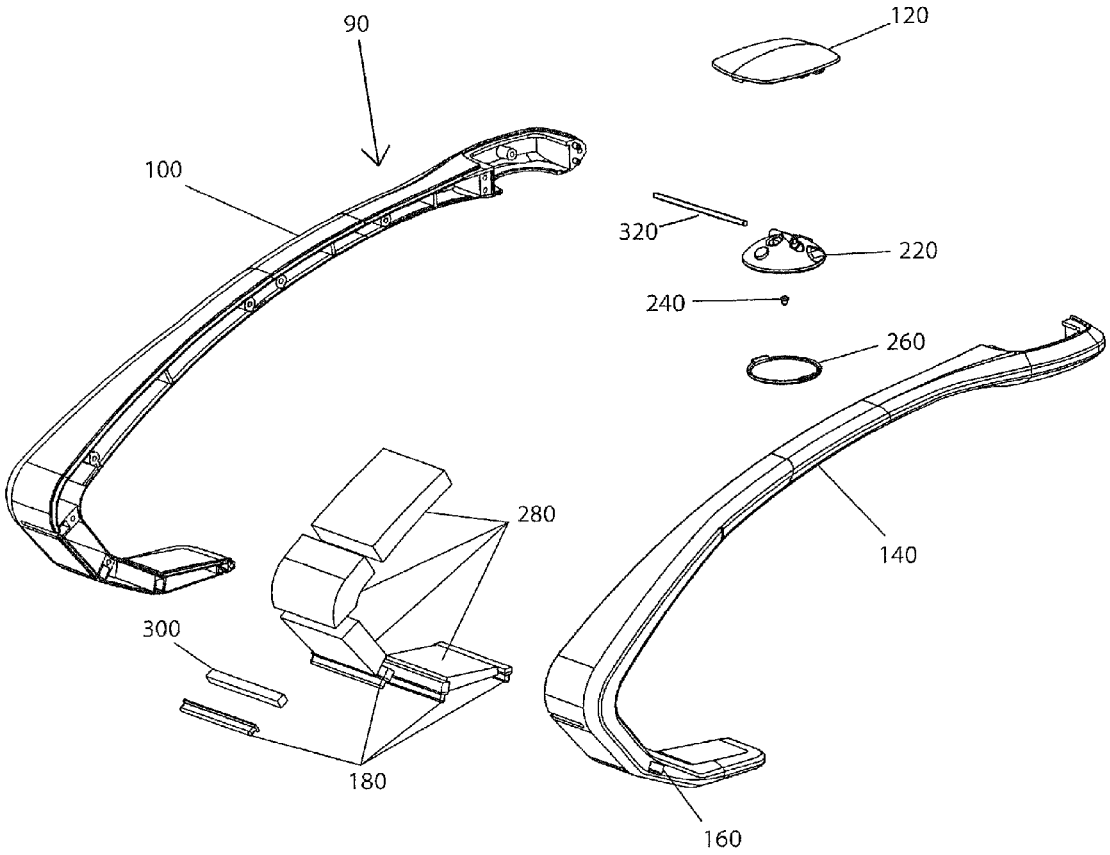
FIG. 7 is an exploded view of the lamp of FIG. 6.
Figure 8:
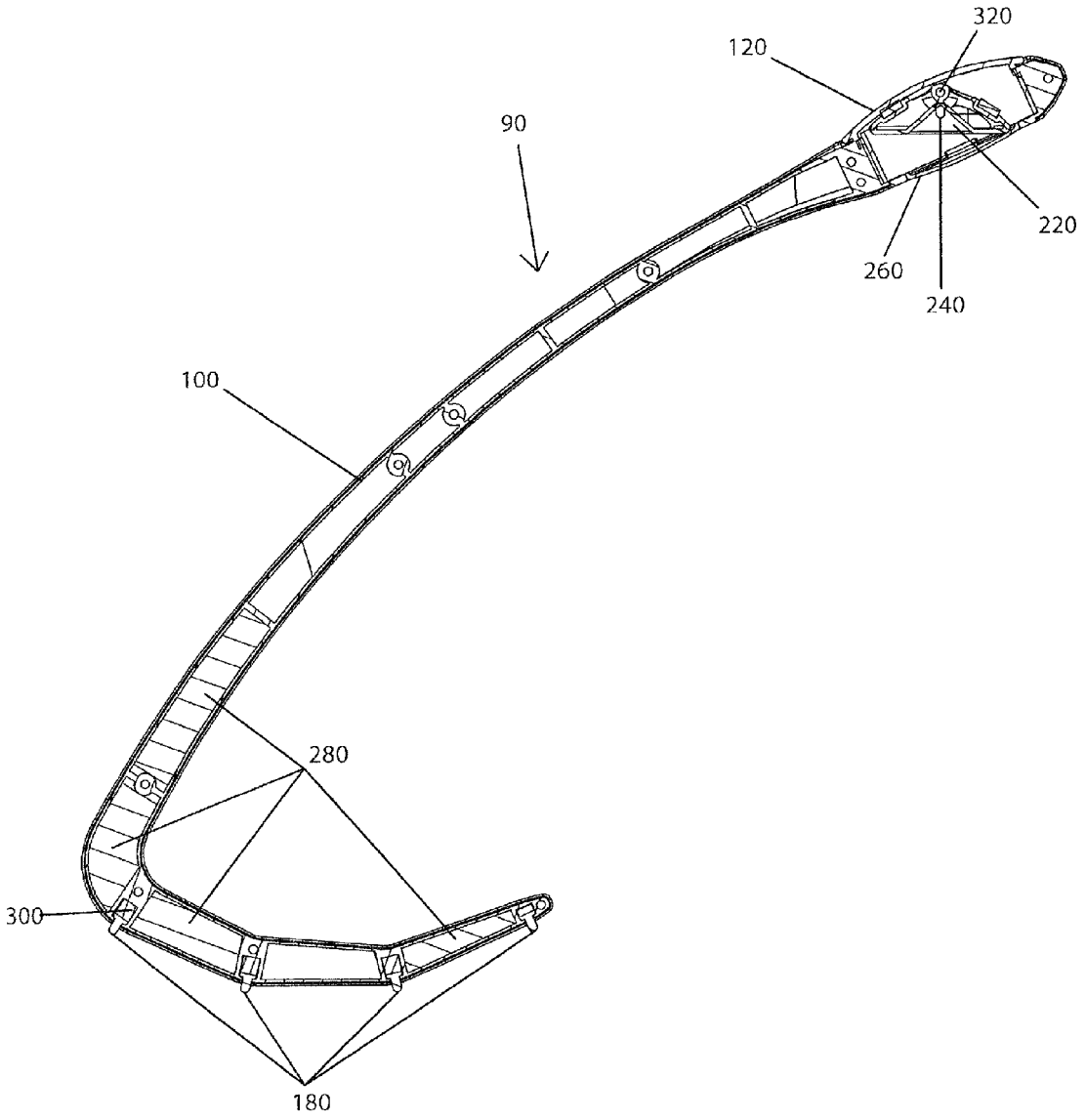
FIG. 8 is a section view of the lamp of FIG. 6 taken through the center plane.

Additional examples of the task lamp are shown in FIGS. 6-14. FIG. 6 depicts a perspective view of another task lamp (90) in an assembled state. As seen in the exploded view in FIG. 7 task lamp (90) is comprised of multiple parts: the body housing left (100), the body housing right (140), the dome (120), the glides (180), memory foam (300), the reflector axle (320), the LED (240), the reflector (220), the lens (260), and the weight (280). To assemble the head, the LED (240) gets adhered to the reflector (220). The reflector axle (320) is slid through a hole in the top of the reflector (220). The axle (320) is then received in bosses in the housing. The head assembly (118) (consisting of parts 120, 220, 240, 260, and 320) along with the glides (180), memory foam (300) and the weight (280) all gets captured in between the body housing left (100) and the body housing right (140) as depicted in FIG. 8.

FIG. 8 shows the lamp (90) in a section view through its central plane, showing the placement of all the internal components. As seen in FIG. 8 the reflector axle (320) is located at the top of the reflector (220). This creates a gimbal effect and uses gravity to keep the reflector (220) facing downward despite which angled surface (340, 360, 380) the lamp is resting on. The movement of the gimbal effect in the reflector (220) can be seen in FIGS. 10 and 11.

Figure 12:
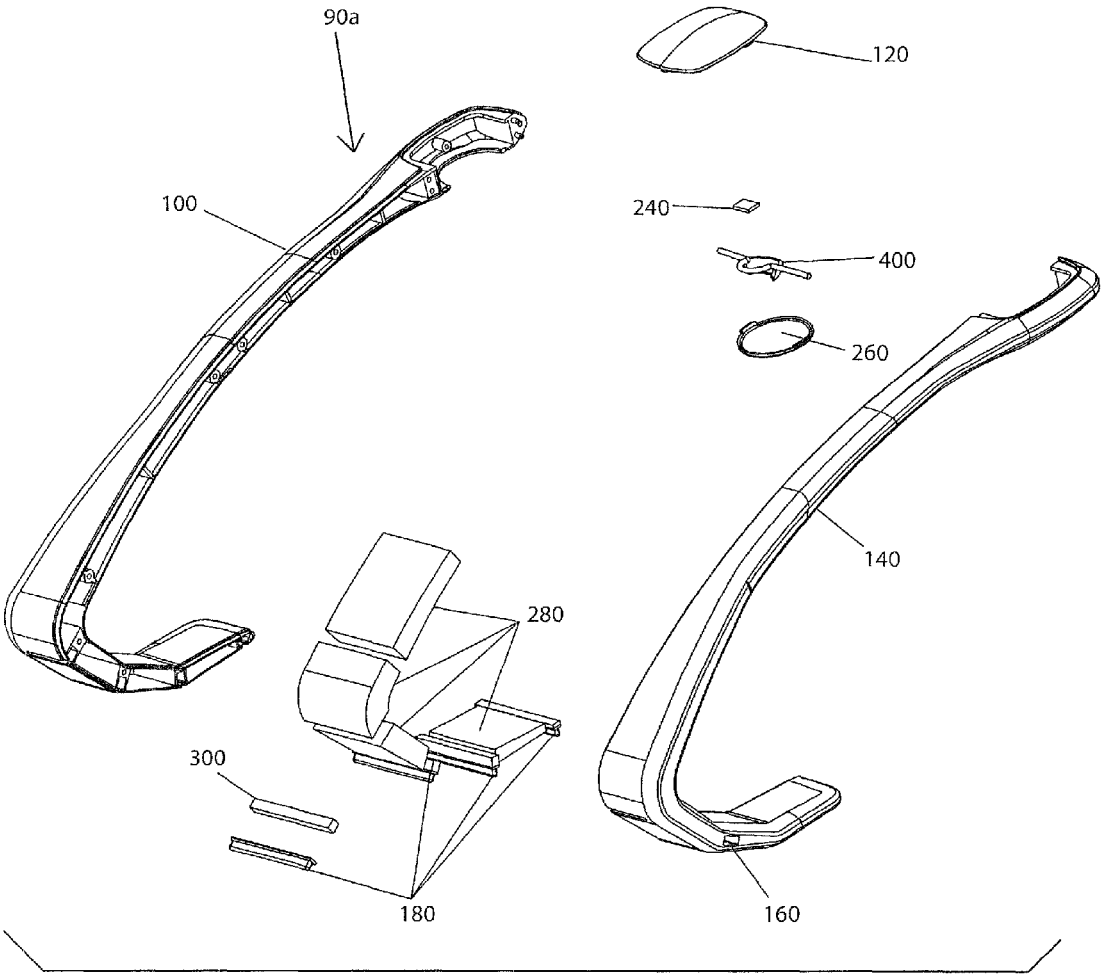
FIG. 12 is an exploded view of another example of the lamp that uses a shade.

The lamp (90*a*) could also be built with the LED (240) adhered directly to the dome (120). This scenario can be seen in FIGS. 12, 13 and 14. An LED shade (400) would use the same gimbal motion of the reflector (220) but instead of moving the light source it moves the LED shade (400) around a fixed LED (240) to prevent exposure of the light source to users. LED shade (400) is preferably generally conical, or a half cone as shown in FIG. 12, to block light from projecting forward of the lamp.

Figures 9A, 9B, 9C:
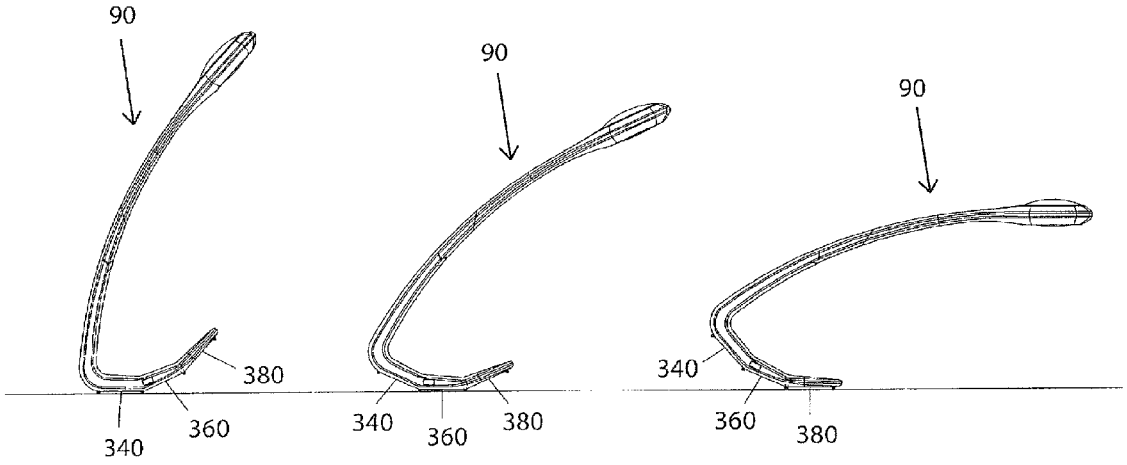
FIGS. 9A, 9B and 9C depict the lamp of FIG. 6 in the three angle positions.

The weight (280) captured in the base (see FIG. 8) allows the lamp to balance on one of the three angled surfaces at a time (340, 360, 380). The angled surfaces are created by the geometry of the base. FIG. 9 shows how the three angled surfaces (340, 360, 380) on the base manipulate the height and reach of the lamp. The geometry depicted shows three facets (340, 360, 380) allowing for three different height and reach options. The lamp could include more or fewer facets to allow for more or fewer options of height and reach.

The glides (180) can have a memory foam (300) placed behind them to dampen the movement of the lamp and help eliminate rocking. Memory foam (300) is used so there is no spring back of the lamp when setting to the desired angled surface (340,360,380)

To use lamps 90 and 90*a*, the user would activate the on/off switch located on the dome (120), this would turn the LED (240) on. The user can select which angled surface (340, 360, 380) would give them the correct height and reach for the task at hand. The base glides (180) make smooth and slippery contact points to the work surface so the lamp can be slid around with ease. Once the user has the lamp in the most ergonomic position on the work surface, they can use the on/off switch to dim or brighten the lumen output of the LED (240).

A number of implementations have been described. Nevertheless, it will be understood that additional modifications may be made without departing from the scope of the inventive concepts described herein, and, accordingly, other embodiments are within the scope of the following claims.

What is claimed is:

1. A task lamp, comprising:

a housing having a rigid angled shape extending at an angle between a lower end portion and an upper end portion, wherein the lower end portion is adapted to rest on a support surface, and wherein the upper end portion is located above the lower end portion, when the lower end portion is resting on the support surface; and a light source attached at a distal end of the upper end portion of the housing;

wherein the lower end portion of the housing comprises at least two angled bottom surfaces that are flat and adapted to each separately rest on or over the support surface, so as to support the housing at a selected orientation that positions the height of the light source at a particular position relative to the support surface, wherein each selected orientation of the housing and corresponding selected location of the light source relative to the support surface is different for each angled surface resting on or over the support surface.

2. The task lamp of claim 1, further comprising a weight disposed at a transition angle between the upper and lower portions of the housing for balancing the housing in the selected orientation.

3. The task lamp of claim 2, wherein the housing comprises a left section and a right section that encloses the weight inside the housing.

4. The task lamp of claim 1, wherein the light source is received in a cavity within the housing.

5. The task lamp of claim 1, further comprising a reflector located above the light source.

6. The task lamp of claim 1, further comprising a shade disposed around the light source, wherein the shade is gimbaled such that the shade remains in substantially the same orientation relative to the support surface as the housing is moved between orientations supported by the at least two angled bottom surfaces.

7. A task lamp, comprising:

a housing having an angled shape with a rear transition angle between an upper portion and a lower portion of the housing, wherein the upper portion extends forward and upward from the rear transition angle and the lower portion extends forward and downward from the rear transition angle;

a lighting assembly having a light source, wherein the lighting assembly is attached at the upper portion of the housing with the light source configured to direct light downward to a support surface;

wherein the lower portion comprises first and second bottom surfaces that are angled from each other and are flat so that each is adapted to separately rest on or over the support surface;

wherein, when the housing is moved to a selected one of the first and second bottom surfaces resting on or over the support surface, an orientation of the housing is adjusted to cause the upper portion of the housing to move to position the light source at a corresponding selected height relative to the support surface; and a base weight concealed within the housing and attached to the housing at or near the rear angle transition to counterbalance the weight of the light assembly for the housing to the balance on one of the first and second bottom surfaces.

8. The task lamp of claim 7, wherein a gimbaled portion of the lighting assembly is movably attached at and at least partially concealed within the upper portion of the housing, and wherein the gimbaled portion is configured to move relative to the housing to consistently direct light emanating from the light source downward to the support surface when the housing is moved between the first and second bottom surfaces resting on the support surface.

9. The task lamp of claim 8, wherein the gimbaled portion of the lighting assembly comprises a shade disposed around the light source, and wherein the shade remains in substantially the same orientation relative to the support surface as the housing is moved between orientations supported by the first and second bottom surfaces.

10. The task lamp of claim 8, wherein the lighting assembly comprises a reflector located above and attached to the light source.

11. The task lamp of claim 7, wherein the housing includes a front surface and a rear surface that each extend along and between opposing sides of the upper and lower portions of the housing, and wherein a thickness between the front and rear surfaces is generally consistent along the upper and lower portions of the housing.

12. The task lamp of claim 7, wherein the housing includes left and right housing parts that attach together to enclose the base weight within the housing.

13. The task lamp of claim 7, wherein the lower portion of the housing includes a plurality of glide members attached at forward and rearward borders of the first and second bottom surfaces, and wherein two of the plurality of glide members are configured to contact the support surface when one of the first and second bottom surfaces is resting on or over the support surface.

14. The task lamp of claim 7, wherein the lighting assembly is activated by a switch disposed at the upper portion of the housing.

15. The task lamp of claim 14, wherein the switch is operable to dim or brighten the lumen output of the light source.

* * * * *